US005235918A

United States Patent [19]

Durand et al.

[11] Patent Number: 5,235,918

[45] Date of Patent: Aug. 17, 1993

[54] RAILWAY BOGIE WITH IMPROVED STABILITY AND BEHAVIOR IN CURVES HAVING A SLIDABLY MOUNTED AXLE BOX ARM

[75] Inventors: Charles R. Durand; Jerome C. Durand, both of Corlay, France

[73] Assignee: ANF-Industrie, Crespin, France

[21] Appl. No.: 613,860

[22] PCT Filed: Jun. 19, 1989

[86] PCT No.: PCT/FR89/00310

§ 371 Date: Jan. 12, 1990

§ 102(e) Date: Jan. 12, 1990

[87] PCT Pub. No.: WO89/12566

PCT Pub. Date: Dec. 28, 1989

[30] Foreign Application Priority Data

Jun. 17, 1988 [FR] France ..... 88 08132
Oct. 5, 1988 [FR] France ..... 88 13016

[51] Int. Cl.[5] ..... B61F 5/26

[52] U.S. Cl. ..... 105/222; 105/168; 105/218.2

[58] Field of Search ..... 105/165, 167, 168, 199.3, 105/206.1, 218.1, 218.2, 222, 223, 224.05, 224.06

[56] References Cited

U.S. PATENT DOCUMENTS

| | | | |
|---|---|---|---|
| 435,918 | 9/1890 | Clark | 105/168 |
| 470,935 | 3/1892 | Heath | 105/165 |
| 856,626 | 6/1907 | Drew | 105/167 |
| 1,347,878 | 7/1920 | Sisson | 105/165 |
| 1,744,986 | 1/1930 | Richards | 105/165 |
| 2,296,106 | 9/1942 | Holland et al. | 105/167 |
| 4,561,360 | 12/1985 | Mulcahy | 105/218.1 X |
| 4,776,283 | 10/1988 | Shozi et al. | 105/222 X |
| 4,968,055 | 11/1990 | Reilly | 105/222 X |

FOREIGN PATENT DOCUMENTS

| | | |
|---|---|---|
| 3424531 | 1/1985 | Fed. Rep. of Germany . |
| 348980 | 11/1960 | Switzerland . |
| 2193941 | 2/1988 | United Kingdom . |

*Primary Examiner*—Michael S. Huppert
*Assistant Examiner*—S. Joseph Morano
*Attorney, Agent, or Firm*—Jacobson, Price, Holman & Stern

[57] ABSTRACT

A railway vehicle truck includes axles (12) with shrunk-on wheels and journalled in axle-boxes (20) connected to a rigid frame (2,4) through a horizontal primary connection comprising a link (18) coupled to the side member (2) of the frame by a resilient swivel joint (14). At least one of the four axle-boxes (20) is longitudinally slidable on a carriage (36) relative to the side member (2). The sliding motions are controlled by a linkage (22,24,26,30) having its input member (22) connected to the body of the vehicle, or by a damper (34) and an automatic return disposed in parallel relation to each other. The device improves on the operation of trucks taking a curve.

14 Claims, 4 Drawing Sheets

RAILWAY BOGIE WITH IMPROVED STABILITY AND BEHAVIOR IN CURVES HAVING A SLIDABLY MOUNTED AXLE BOX ARM

BACKGROUND OF THE INVENTION

The invention relates to a truck for a railway vehicle which comprises an adjustable frame having side members and two axles having shrunk-on wheels and journalled in axle boxes each connected to the frame through a primary suspension comprising a link having one end connected to the axle-box and the other end connected to a side member of the frame through a resilient swivel joint. Such trucks are for example the trucks X32 of the French CORAIL cars. The invention more particularly relates to means for mounting at least one of the axle-boxes so as to allow it a degree of freedom of substantially horizontal relative motion with respect to the frame.

Present railway technique has permitted the development of railway trucks having wheels shrunk on the axle spindles which conserve good characteristics of stability up to speeds of 400 km/h and even beyond. Such trucks are based on the principle of a double suspension: a primary suspension and a secondary suspension, these two suspensions being separated by an intermediate movable element between the axles and the body of the vehicle designated truck frame.

It is known that the motions of instability at high speed (or biconical motions of undamped axles) can be suppressed in particular by high primary stiffnesses of the primary suspension considered in the horizontal plane.

Unfortunately, the stiffening of the horizontal flexible connections which maintain the axle-boxes relative to the truck frame has resulted in the concerned trucks badly taking the curves, i.e. the axles become decentered relative to the two rail lines and the wheel flanges come to abut against the outer rail of the curve, especially the wheel of the front axle of each truck.

A drawback of this phenomenon is that the contact of the wheel flanges results in both wear on the wheel flanges themselves and wear on the rolling surfaces of the wheels. A second drawback is that, in a curve, the axles effected by the contact between the flange and outer rail follows the defects on the inner rounded portion of the rail on which the contact occurs and the suspension transmits undesirable forces to the body.

The adoption of the greasing of the wheel flanges or the rails in a curve permits combatting the first drawback but not the second. A concern of designers is therefore to propose a solution for correctly positioning the axles with respect to the track, even in a curved track, with the centers of the axle-boxes located at the four corners of a rectangle.

Thus, in order to improve the passage through a curve a certain number of specialists have proposed mechanical link systems employing the relative rotational motion of the equipment constituted by the two axles of a truck (or even of each axle of rolling stock with merely axles) relative to the body placed vertically thereabove. These link systems have the purpose of modifying the relative disposition of the axle-boxes with respect to one another as a function of the curve radius so as to obtain in a curve a truck geometry which is more favorable to its taking the curve.

But the systems proposed at present above all aim to create in an established curve a geometry favorable to the truck considered in the free state, i.e. without taking into account semi-slip forces which occur in the contact between the wheels and the rails.

In a certain number of proposed solutions, the position of equilibrium cannot be attained, even if the geometry of the wheels obtained in a curve by a "forced" motion corresponds to a truck which takes the considered curve well, quite simply because the proposed truck is not morphologically designed for an automatic seeking of a correct positioning of the axles with respect to the track. Thus, for example, it is not sufficient to make the axes of two axles of a truck converge in the correct direction for them to make an angle equal to the angle at the center from which is seen, from the center of the considered curve, a segment equal to the wheelbase of the truck so that this truck behaves well in the considered curve. In failing to take certain constructional precautions, the detail of which constitutes a characteristic of the present invention and will be explained hereinafter, there is a risk that a truck according to the aforementioned example will place itself across the curved track and advance crabwise.

There are, for example, known from the patent documents German DE-A-3 424 531 or European EP-A-165 752, trucks of the type mentioned at the beginning of this description, provided with means for mounting the axle-boxes adapted to enable the axles to assume in a curve a certain inclination relative to the longitudinal axis of the frame. But these means, arranged in parallel with the primary suspension, consist of linkages which fix in position at least two axle-boxes. The primary suspensions are necessarily rendered more flexible and the linkage exerts on the boxes high stresses transmitted by numerous link members which are fragile and liable to result in play, which is therefore unsatisfactory.

BRIEF SUMMARY OF THE INVENTION

An object of the present invention is to improve the behavior in a curve of trucks suitable for high speeds whose stability in yaw was obtained by a suitable stiffening of the primary suspension mechanical connections in the horizontal plane (stiffnesses conventionally designated by the gradients Kx and Ky). This is the case in particular in France of the Y32 equipping the CORAIL cars, the TGV trucks, and the French turbotrain trucks, etc.

It is known that the two axles of such trucks each undergo on a straight-line track coupled transverse and angular motions (about the vertical axis) in damped sinusoids, termed biconical motions or yaw motions, the damped position being a position of equilibrium or relaxation of the horizontal stresses, both internal stresses whose source is in the forces of contact between the wheels and the rail and those, highly attractive, generated by the deviations assumed by the four axle-boxes relative to the four centers of attraction corresponding to the horizontal primary resilient connections (according to the aforementioned gradients Kx and Ky). With regard to a well-constructed truck, this position of relaxation corresponds to centers of attraction disposed at the corners of a horizontal rectangle and it is therefore in accordance with this geometrical figure that the centers of the axle-boxes come to be disposed when the truck travels along a rectilinear and perfect track, i.e. without natural defects of geometry.

If it is considered that the rectilinear track section has only localized geometrical perturbations, the damped biconical motion is started up again for each perturbation, the damping moreover being less and less effective as the speed of the vehicle approaches the speed of instability owing to the harmful effect of the forces of inertia relating to the moving elements involved in the motion.

The present invention is based on the principle, supported by calculations not reproduced here, that for given horizontal primary stiffnesses, conventionally expressed by the coefficients Kx (longitudinally) and Ky (transversely), the motion is substantially of the same type as that described hereinbefore about the position of equilibrium, i.e. that the axles automatically seek their position of equilibrium; it being however necessary that the latter be compatible with the play existing for each axle within the rails. A characteristic of the invention consists in deforming in a curve the aforementioned rectangular disposition of the primary attraction centers by the displacement or traversing of at least one of the centers of attraction relative to the rectangle, whereas according to the technique known from the above documents DE-A-74 24 531 or EP-A-165 752, the axles were fixed without however displacing the centers of attraction which remained located at the corners of a rectangle (which explains the stresses existing in this type of connection).

In respect of the curve of smallest radius to be negotiated and therefore corresponding to a maximum deformation of the rectangle, it will be shown that the figure of equilibrium of the axles (if not of relaxation) is such that none of the flanges comes in contact with the rail. The exact determination of the traversing to be effected depends on the geometric and mechanical data of the problem in question.

This calculation, which is not developed here, involves the aforementioned primary stiffnesses as well as—although to a lesser extent—the horizontal stiffnesses of the secondary suspension, the KALKER coefficients of wheel-rail contact—essentially the two coefficients of longitudinal and transverse semi-slip—and the profile of the tires.

In practice, an approximate value of the amplitude of the traversing corresponds to the convergence toward the center of the curve of the two non-parallel sides of the trapezium obtained from the aforementioned rectangle by the traversing. From the point of view of the construction, to permit the displacement of the centers of attraction, the invention is characterized in that the means for mounting the axle-boxes ensuring the longitudinal selective freedom are interposed, in respect of each box concerned, between the link and either the axle-box, or the side member of the frame. In other words, the mounting is achieved in series with the primary suspension and no longer in parallel therewith.

According to the invention, it is possible not only to traverse, as just mentioned one, two, three or four primary centers of attraction of a truck, but also to achieve this traversing along substantially any curve, the amplitude of the motion itself as a function of the curve possibly satisfying a function which is itself any function to be determined by calculation. The sole limitations to be respected are to effect the traversing motions in such manner as to respect the coplanarity of the four centers and the stress limits imposed by the component parts involved (swivel joints, axle rolling bearings, fatigue limit of the axle spindles, etc.).

In a first embodiment, said mounting means comprise a carriage which is arranged to be longitudinally slidable on the side member and on which is carried the resilient swivel joint of the link, control means being provided for controlling the sliding motions of the carriage with respect to the side member.

Advantageously, a single one of the resilient swivel joints has its transverse pin carried by a sliding carriage, the other three resilient swivel joints having their transverse pins rigidly connected relative to the corresponding side member.

In a first possibility, the means for controlling the sliding motions of the carriage with respect to the side member are constituted by a linkage mounted between the body of the vehicle and said carriage, the pivotings of the body relative to the truck controlling the displacements of the carriage in a manner proportional to the angle of rotation about the vertical axis between the body and the truck frame.

In a variant of the invention, it is not even necessary to modify by means of a mechanical control the position of the primary centers of attraction. The modification of the position of the centers is obtained by the axles themselves, the latter constituting the elements which are both the driving elements and the controlling elements of the carriages carrying the centers. The constructional dispositions required then consist in constraining the motion of the carriage(s) by two actions which act in a parallel manner and consist, one, in braking the motions of the carriages by means of very powerful dampers, and, the other, in creating a resilient return of the carriage to a mean position. The first of these actions, which damps the rapid and pulsatory motions which would occur without this action, does not prevent the damped biconical motion of the axles from occurring and, in particular, the automatic seeking on behalf of the axles of their position of equilibrium both in a straight line and in a curve. On the other hand, the high damping action prevents the motions of instability which appear at high speeds from occurring. The second of the aforementioned actions, which is a resilient return action, is adapted to balance the traction or braking forces.

Such an arrangement is particularly well applicable in a second embodiment of the invention in which the relative freedom mounting means are provided between the link and the axle-box.

In an advantageous embodiment of the variant of the invention, this resilient return of the axle-box to its mean position is achieved by an effect of gravity, but it must be understood that this resilient return may also be obtained by means of a spring having sufficient dimensions to be capable of opposing the forces developed on the rim.

Advantageously, both the desired longitudinal motion and the return by the effect of gravity are obtained by means of a mounting in the axle-box of smooth bearings having an axis which is eccentric relative to the axis of the axle.

The damper is fixed, preferably substantially vertically, between the attachment journals respectively connected to the axle-box and the link.

According to yet another variant, the link end comprises, adjacent to the axle, a bore in which the axle-box rolls, it being maintained therein by one or more centering studs disposed on the upper generatrix of the aforementioned bore.

BRIEF DESCRIPTION OF THE DRAWINGS

Further features and advantages of the invention will be apparent from the following detailed description of a particular embodiment with reference to the accompanying drawings wherein.

DETAILED DESCRIPTION

Figure 1:
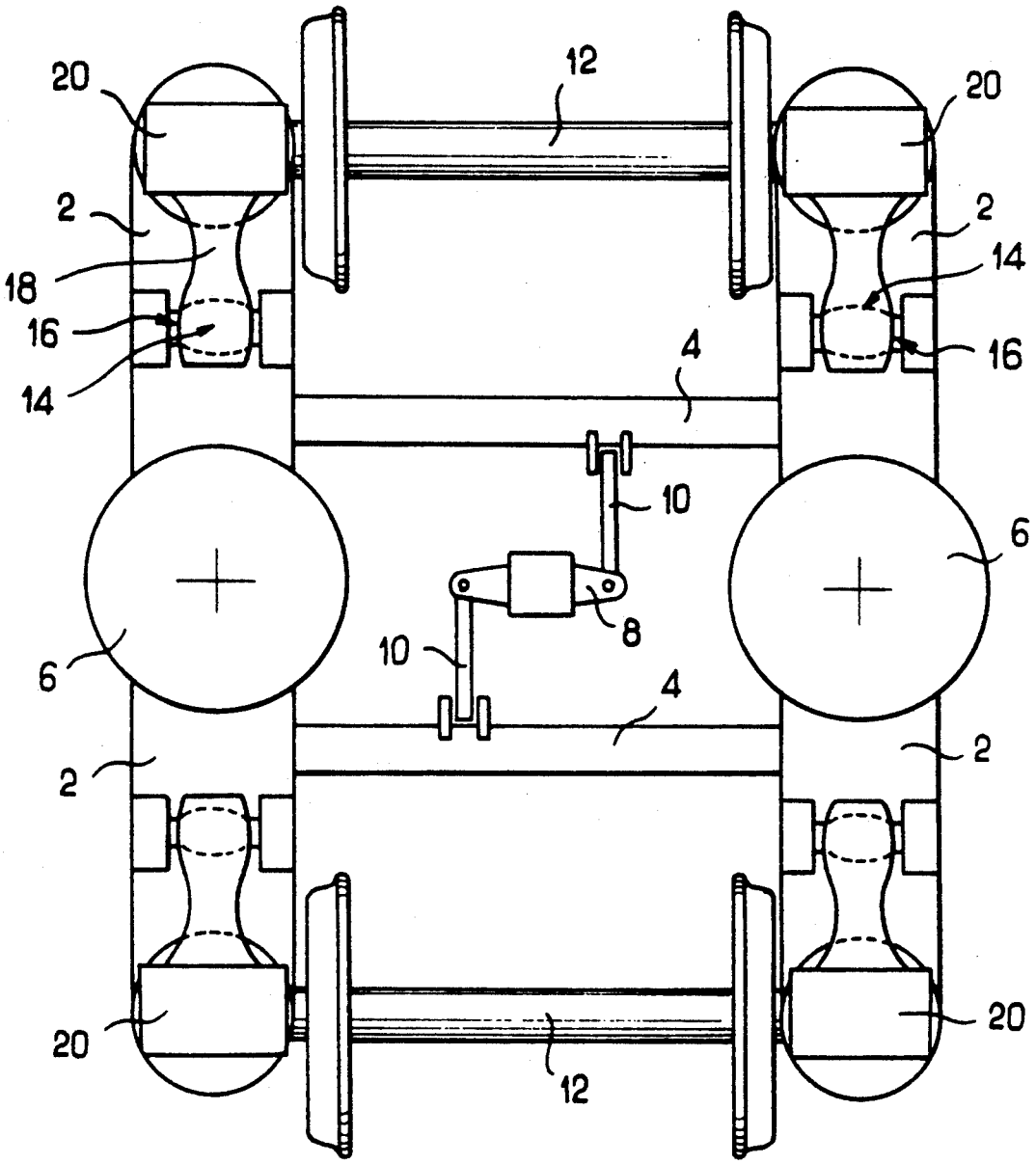
FIG 1 (PRIOR ART)
FIG. 1 is a bottom plan view of a truck frame to which the invention is applied.

With reference to FIG. 1, there is seen a truck frame constituted by two side members 2 interconnected by cross-members 4. The secondary suspension, not shown, bears against circular enlarged portions 6 of the frame side members. The driving of the body is achieved in a conventional manner through a swing bar 8 which is journalled on a body pivot and connected at its ends to the cross-members 4 through bars 10.

The primary connections between the axles 12 and the truck frame are achieved also in a conventional manner through four resilient swivel joints 14 whose transverse axes 16 are rigidly maintained with respect to the side members 2. These swivel joints resiliently maintain the axle bearings by means of four axle-box links 18 connected to the axle-boxes 20 so that, in the absence of horizontal forces exerted on the axle-boxes, the centers of the latter are located at the corners of a rectangle.

Figure 2:
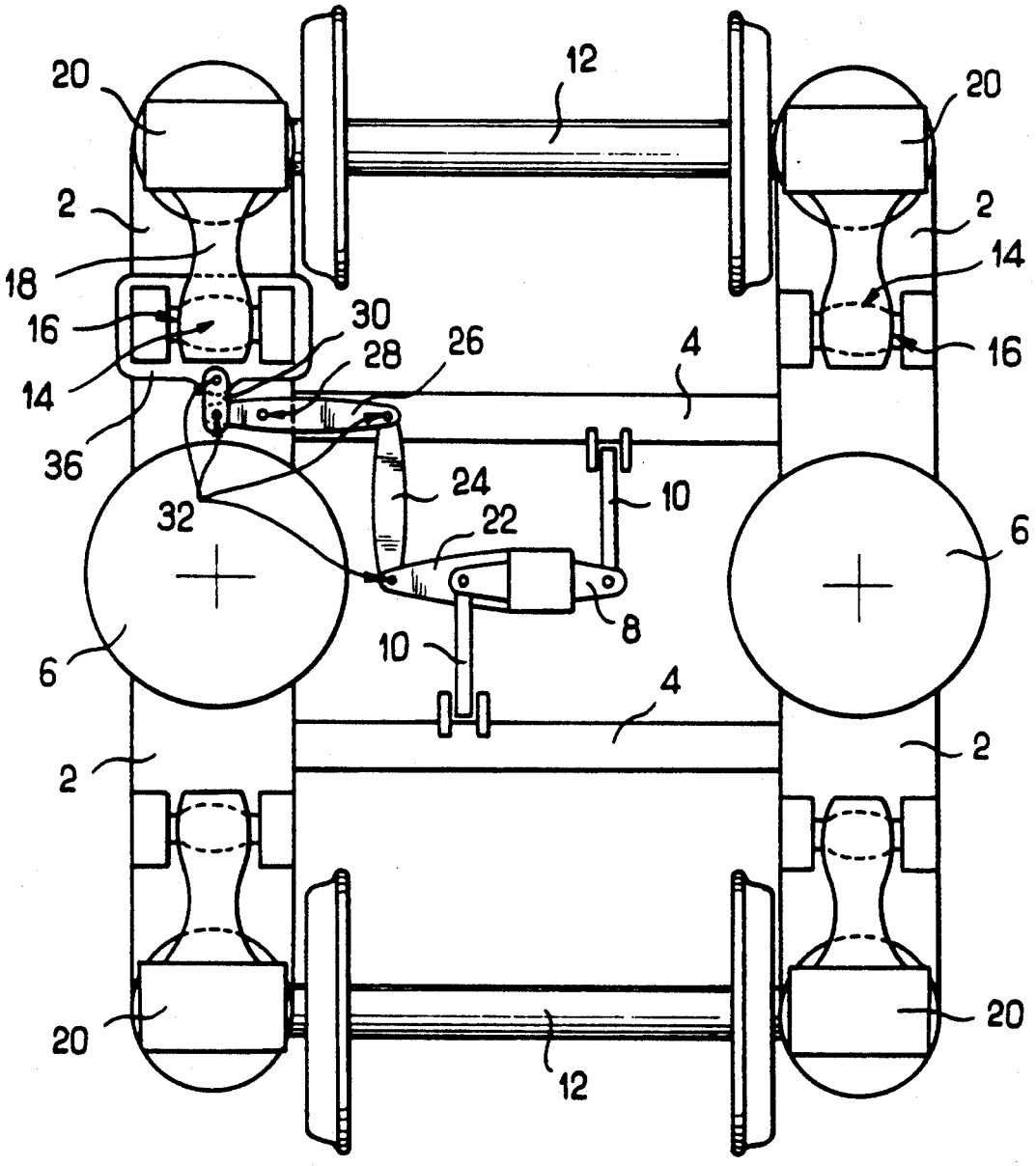
FIG. 2 is a bottom plan view of the truck frame, showing the principle of the orientation explained hereinbefore, applied to a single axle-box of a truck, the motion of the carriage being a motion of rectilinear and longitudinal translation, the amplitude being moreover substantially proportional to the curvature of the track.

In FIG. 2 which represents a device according to the invention and is derived from the conventional arrangement represented in FIG. 1, one of the four swivel joints, namely that placed on the top left side of the Figure, disposed inside a carriage or slide 36, is longitudinally slidable in slideways connected to the upper branch of the side member 2, located on the left side of the Figure. The motion of very small amplitude (on the order of a centimeter) from a mean position, is produced by the motion of relative rotation between the body and the truck owing to a lever 22 connected to the body substantially at the same height dimension as the driving swing bar or the axes of the axles. It is rigidly fixed, for example, to the body pivot and actuates a longitudinal connector 24, then a transverse lever 26 journalled on a pin 28 fixed relative to the side member 2, and lastly a longitudinal connector 30 which drives the slide in which the swivel joint 14 is mounted.

The articulations 32 of the various connectors and swing bars mentioned have only a minimum of play and may possibly receive flexible linings, but in the latter case, the flexibility of these linings must not substantially modify the desired flexibility on the axle-box in question which is that given by the swivel joint 14.

Figure 3:
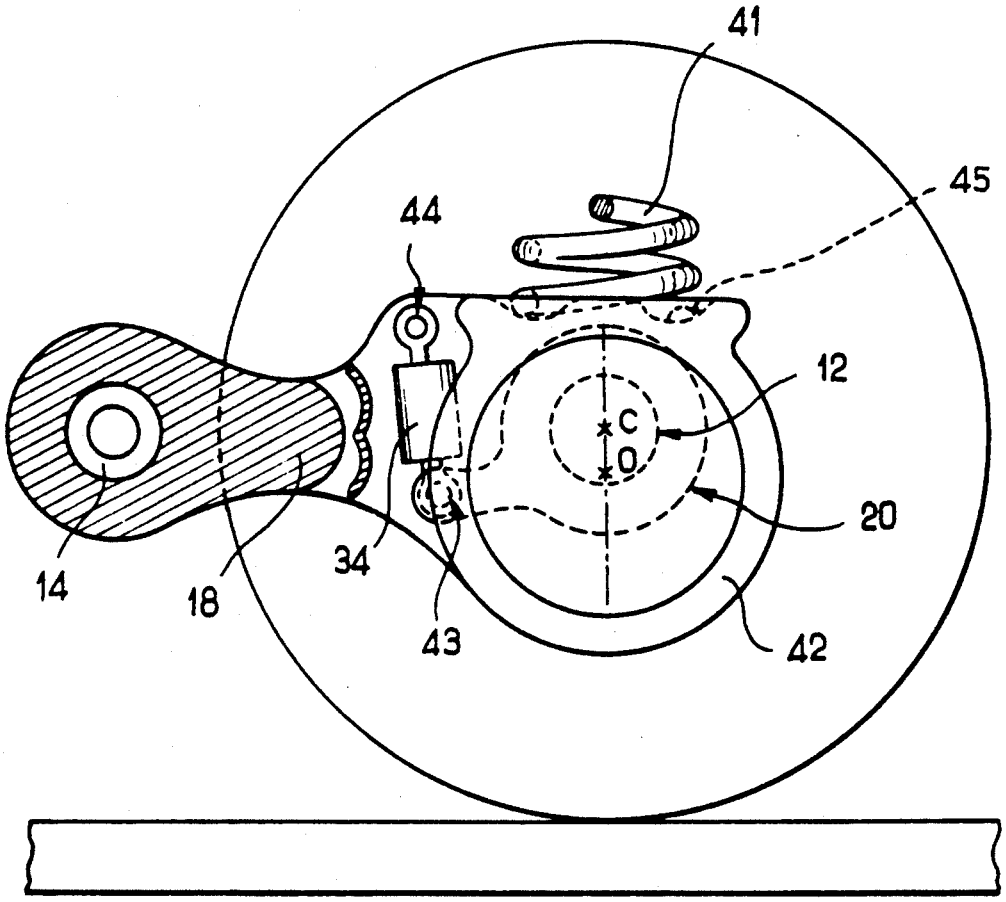
FIG. 3 is an elevational view, partly in cross section, of a further embodiment of the invention, showing the detail of the means for mounting the axle-box according to the invention.

According to the variant of the invention, the primary connection of at least one of the axle-boxes 20 comprises, interposed between the link 18 and the considered box 20, mounting means, the detail of which is given in FIG. 3, which allows a horizontal relative motion between the link—and consequently the frame—and the axle-box 20.

The box link 18 comprises, adjacent to the axle, a seat 45 in its upper part for receiving and centering the primary suspension spring 41 provided for the considered axle-box 20 and supporting, in a conventional manner not shown, an end of a side member 2 of the truck frame.

Further, the box link 18 maintains, the axle-box 20 by means of two vertical cheeks 42 which also constitute smooth bearings the bore axis of which, represented by the point 0, is eccentric relative to the axis of the axle 12 represented by the point C in FIG. 3. The eccentricity is typically about 3 to 5 cm.

In the absence of a propelling or braking force, the center C of the axle 12 is located vertically above the center 0 of the eccentric bearing of the axle-box.

On the other hand, under the effect of propelling or braking forces, the segment CO assumes an inclination to the vertical, which provides the necessary longitudinal motion (on the order of a centimeter for example). The axle 12 is then returned to its original position under the effect of gravity by a return force which is a function of the vertical weight exerted on the axle-box 20 in question, of the eccentricity CO and of the displacement of the axle-box 20 relative to its original position or mean position.

Further, the box body 20 comprises, on a suitable projection, a lower attachment 43 of the damper 34, the upper attachment 44 being fixed to the box link 18. These two attachments 43 and 44 are constituted by journals.

It will be observed that FIG. 3 represents a damper whose axis is nearly vertical. Such an arrangement, without being obligatory, provides a protection against risks of leakage of the damper, the latter being then immersed in the conventional manner in an oil reservoir which performs the function of a feeder for re-feeding the damper.

Lastly, note that the use of viscous dampers permits attaining a quasi-total relaxation of the forces at the rim in an established condition of operation either in a straight line or in an established curve. But it is also possible to employ friction dampers. In this case, residual forces subsist even in an established condition of operation. On the other hand, such friction dampers involve no risk of leakage of liquid and consequently afford maximum operational safety.

Figure 4:
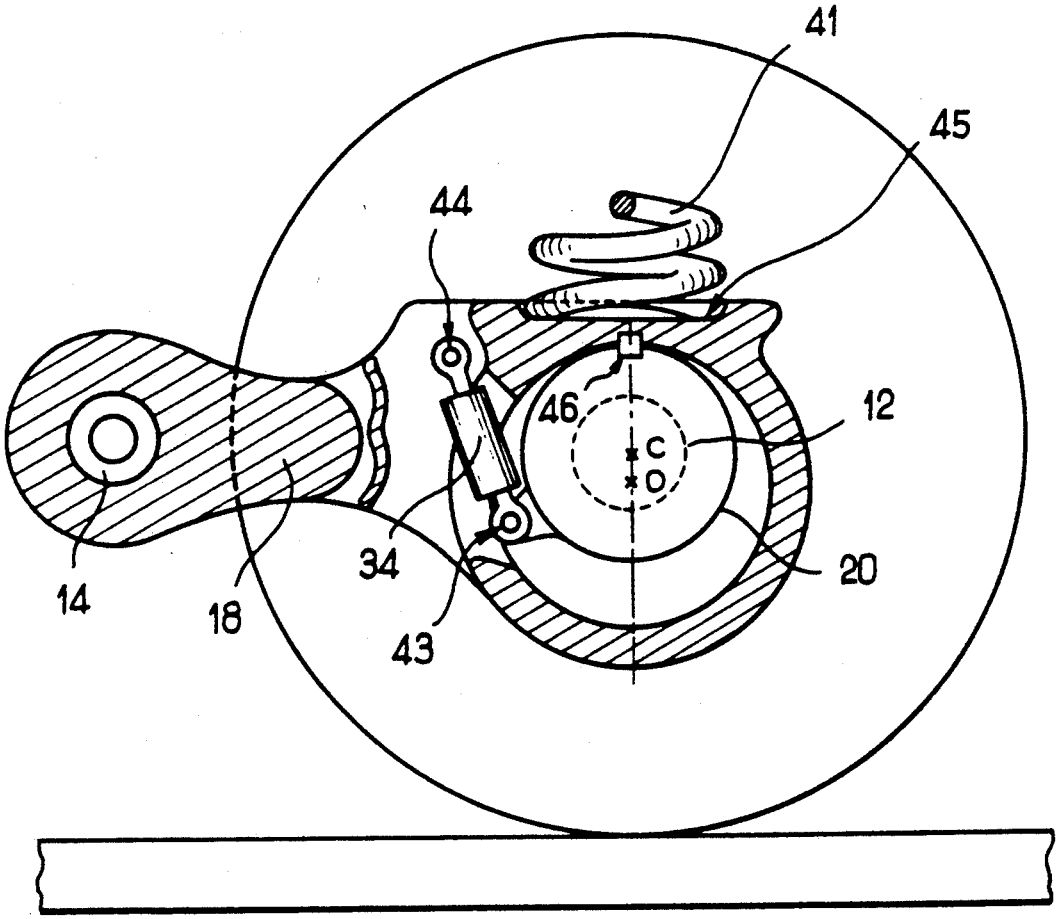
FIG. 4 is a view similar to FIG. 3 showing another manner of achieving the connections between the truck frame and the axle box according to the invention.

In FIG. 4, the longitudinal mobility of the axle-box 20 with respect to the box link 18 is achieved by a slip-free rolling of the axle-box 20 in a transverse bore formed in the box link adjacent to the axle. The axis of this bore corresponds to the trace C in the section plane of FIG. 4. The slip-free rolling of the axle-box in the aforementioned bore is achieved by means of one or more centering studs 46 engaged between the box link and the body of the axle-box and placed on the contact generatrix of these two component parts. The fact of providing a plurality of centering studs permits preventing the axle-box and the bore from becoming off-center which is liable to occur under the effect of transverse forces.

The arrangement shown in FIG. 4 has the advantage of greatly reducing the effect of the dry frictions.

We claim:

1. In a truck for a railway vehicle body running on a track including a rigid frame having side members and two axles journalled in axle-boxes and shrunk-on wheels on the axles, the axle-boxes each being connected to the frame through a respective primary suspension link having one end connected to the axle-box and the other end articulated to a respective one of said side members of the frame through a resilient swivel joint, the swivel joint being sufficiently stiff for damping yaw motions of the truck at the highest speeds encountered in the use thereof, the improvement comprising:

carriage means mounted between at least one of said axle-boxes and said frame on said respective one of said side members for horizontal and longitudinal sliding movement thereon, one of said resilient swivel joints of said link being mounted on said carriage means; and controls means for sliding said carriage means relative to said respective one of said side members as a function of the radius of curvature of the track.

2. The truck as claimed in claim 1, wherein:

said control means comprises linkage means operatively connected between the vehicle body, the frame and said carriage means, so that pivoting of the body relative to the truck controls displacements of said carriage.

3. In a truck for a railway vehicle body running on a track including a rigid frame having side members and two axles journalled in axle-boxes and shrunk-on wheels on the axles, each axle-box being connected to the frame through a respective primary suspension link having one end connected to the axle-box and the other end articulated to a respective one of said side members of the frame through a resilient swivel joint, the swivel joint being sufficiently stiff for damping yaw motions of the truck at the highest speeds encountered in the use thereof, the improvement comprising:

mounting means for mounting at least one of said axle-boxes on a respective one of said primary suspension links for relative longitudinal displacement substantially parallel to the direction of travel of the truck so that at least one of said axle-boxes is automatically returnable to a position of equilibrium thereof, said mounting means comprising a rotatable connection means between said at least one of said axle-boxes and said respective one of said links for relative rotation therebetween about an axis eccentric to the central axis of rotation of the axle journalled in said at least one of said axle-boxes; and damper means mounted between said at least one of said axle-boxes and said respective one of said primary suspension links for damping said relative longitudinal displacement.

4. The truck as claimed in claim 3 wherein:

said damper means is disposed so that the action thereof is substantially vertical.

5. The truck as claimed in claim 4 wherein:

a substantially radially extending arm is provided on said at least one axle-box; and said damper means comprises a substantially linear acting damper device connected between said arm and said one link.

6. In a truck for a railway vehicle body running on a track including a rigid frame having side members and two axles journalled in axle-boxes and shrunk-on wheels on the axles, each axle-box being connected to the frame through a respective primary suspension link having one end connected to the axle-box and the other end articulated to a respective one of said side members of the frame through a resilient swivel joint, the swivel joint being sufficiently stiff for damping yaw motions of the truck at the highest speeds encountered in the use thereof, the improvement comprising:

mounting means for mounting at least one of said axle-boxes on a respective one of said primary suspension links for relative longitudinal displacement substantially parallel to the direction of travel of the truck so that said at least one of said axle-boxes is automatically returnable to a position of equilibrium thereof, said mounting means comprising, a curved internal bearing surface in said respective one of said suspension links and having a central axis eccentric relative to the central axis of rotation of the axle journalled in said at least one of said axle-boxes, a curved external bearing surface on said at least one of said axle-boxes in rolling contacting engagement with said curved internal bearing surface; and damper means mounted between said at least one of said axle-boxes and said respective one of said primary suspension links for damping said relative longitudinal displacement.

7. The truck as claimed in claim 6 wherein:

said curved internal bearing surface is in one end of said one link; and said axle-box is automatically returnable by gravity.

8. The truck as claimed in claim 7 and further comprising:

a centering stud means engaging between said curved bearing surfaces to prevent slipping therebetween while permitting said rolling contact.

9. The truck as claimed in claim 8 wherein:

said damper means is disposed so that the action thereof is substantially vertical.

10. The truck as claimed in claim 9 wherein:

a substantially radially extending arm is provided on said at least one axle-box; and said damper means comprises a substantially linear acting damper device connected between said arm and said one link.

11. The truck as claimed in claim 7 wherein:

said damper means is disposed so that the action thereof is substantially vertical.

12. The truck as claimed in claim 8 wherein:

a substantially radially extending arm is provided on said at least one axle-box; and said damper means comprises a substantially linear acting damper device connected between said arm and said one link.

13. The truck as claimed in claim 6 wherein:

said damper means is disposed so that the action thereof is substantially vertical.

14. The truck as claimed in claim 6 wherein:

a substantially radially extending arm is provided on said at least one axle-box; and said damper means comprises a substantially linear acting damper device connected between said arm and said one link.

* * * * *